US008833489B2

(12) United States Patent
Hogset et al.

(10) Patent No.: US 8,833,489 B2
(45) Date of Patent: Sep. 16, 2014

(54) METHOD AND SYSTEM FOR TRANSFERRING SIGNALS THROUGH A DRILL PIPE SYSTEM

(75) Inventors: Tore Hogset, Stavanger (NO); Espen Alhaug, Stavanger (NO)

(73) Assignee: Reelwell AS (NO)

( * ) Notice: Subject to any disclaimer, the term of this patent is extended or adjusted under 35 U.S.C. 154(b) by 438 days.

(21) Appl. No.: 13/322,464

(22) PCT Filed: Apr. 27, 2010

(86) PCT No.: PCT/NO2010/000153

§ 371 (c)(1), (2), (4) Date: Feb. 13, 2012

(87) PCT Pub. No.: WO2010/137986

PCT Pub. Date: Dec. 2, 2010

(65) Prior Publication Data

US 2012/0125686 A1 May 24, 2012

(30) Foreign Application Priority Data

May 26, 2009 (IE) ..... S2009/0407

(51) Int. Cl.

| | |
|---|---|
| ***E21B 47/16*** | (2006.01) |
| ***E21B 17/00*** | (2006.01) |
| ***E21B 17/18*** | (2006.01) |
| ***E21B 21/12*** | (2006.01) |
| ***E21B 47/12*** | (2012.01) |

(52) U.S. Cl.

CPC ..... *E21B 17/18* (2013.01); *E21B 17/003* (2013.01); *E21B 21/12* (2013.01); *E21B 47/12* (2013.01)

USPC ..... 175/40; 340/854.4

(58) Field of Classification Search

USPC ..... 175/40, 320, 215; 340/854.4, 854.6, 340/853.3; 166/380, 77.2, 65.1; 285/123.3

See application file for complete search history.

(56) References Cited

U.S. PATENT DOCUMENTS

| | | | | |
|---|---|---|---|---|
| 2,795,397 | A * | 6/1957 | Hull et al. | 174/47 |
| 3,786,878 | A * | 1/1974 | Chapman | 175/320 |
| 4,537,457 | A | 8/1985 | Davis, Jr. et al. | |
| 4,722,402 | A * | 2/1988 | Weldon | 175/104 |
| 4,806,115 | A | 2/1989 | Chevalier et al. | |

(Continued)

FOREIGN PATENT DOCUMENTS

WO 0210549 A2 2/2002

OTHER PUBLICATIONS

International Preliminary Report on Patentability in PCT/NO2010/000153, issued Mar. 7, 2011.

(Continued)

*Primary Examiner* — Daniel P Stephenson
(74) *Attorney, Agent, or Firm* — Adenike Adebiyi

(57) ABSTRACT

The present invention relates to a system for transferring signals through a drill pipe system during drilling of a subsurface well. The drill pipe system comprises a first pipe (1) provided concentric inside a second pipe (2) by means of hanging devices (3, 3*a*). The first pipe (1) is electrically insulated from the second pipe (2). A first signal transceiver is electrically connected to the top of the drill pipe system. A second signal transceiver is electrically connected along or in the bottom of the drill pipe system. The first and second signal transceivers are electrically connected to the first and second pipes (1, 2) for transferring the signals through the drill pipe system.

13 Claims, 7 Drawing Sheets

(56) References Cited

U.S. PATENT DOCUMENTS

| | | | | |
|---|---|---|---|---|
| 5,334,801 | A | 8/1994 | Mohn | |
| 6,079,505 | A | 6/2000 | Pignard et al. | |
| 6,367,564 | B1 | 4/2002 | Mills et al. | |
| 6,633,236 | B2 * | 10/2003 | Vinegar et al. | 340/854.4 |
| 6,688,396 | B2 | 2/2004 | Floerke et al. | |
| 6,766,141 | B1 * | 7/2004 | Briles et al. | 455/40 |
| 6,866,306 | B2 * | 3/2005 | Boyle et al. | 285/333 |
| 7,518,528 | B2 * | 4/2009 | Price et al. | 340/854.6 |
| 2005/0103527 | A1 | 5/2005 | Church et al. | |
| 2007/0102197 | A1 * | 5/2007 | Rotthaeuser | 175/320 |
| 2007/0247328 | A1 * | 10/2007 | Petrovic et al. | 340/853.7 |
| 2009/0174409 | A1 * | 7/2009 | Coates et al. | 324/338 |
| 2010/0149056 | A1 * | 6/2010 | Contant et al. | 343/719 |
| 2010/0314107 | A1 * | 12/2010 | Vestavik | 166/250.01 |
| 2011/0192604 | A1 * | 8/2011 | Livingstone | 166/302 |
| 2012/0125686 | A1 * | 5/2012 | Hogseth et al. | 175/40 |
| 2012/0222858 | A1 * | 9/2012 | Stimpfle-Ziegler | 166/242.6 |
| 2013/0014992 | A1 * | 1/2013 | Sharp et al. | 175/45 |
| 2013/0027216 | A1 * | 1/2013 | Jantz et al. | 340/854.4 |
| 2013/0265171 | A1 * | 10/2013 | Hay | 340/854.4 |
| 2013/0342354 | A1 * | 12/2013 | Petrovic et al. | 340/854.6 |

OTHER PUBLICATIONS

Written Opinion of the International Searching Authority in PCT/NO2010/000153, issued Dec. 15, 2010.

International Search Report in PCT/NO2010/000153, issued Dec. 15, 2010.

* cited by examiner

METHOD AND SYSTEM FOR TRANSFERRING SIGNALS THROUGH A DRILL PIPE SYSTEM

FIELD OF THE INVENTION

The present invention relates to a method and system for transferring signals through a drill pipe system during drilling of a subsurface well.

BACKGROUND

During drilling operations of subsurface wells, such as hydrocarbon wells or water injection wells, there is a need for communication between the well and the surface. In many situations it is desired to monitor the pressure in the bottom and, if possible, also along the well. In this case sensors are located in the bottom and/or along the drill pipe system.

The common way of transferring signals through a drill pipe system is to use so-called mud pulse telemetry, where a valve located in the bottom of the drill pipe system is throttled in short periods and thereby pressure pulses are generated. The pressure pulses propagate through the mud/fluid to the surface of the well, where the pressure pulses are measured and converted to electrical signals etc.

This type of equipment are often assembled of a number of modules, such as a pulse sending module, a turbine module using the fluid flow for producing electrical power, a number of sensing modules and directional drilling equipment.

There are several disadvantages with this type of technology. First of all, the data rate is low, typically 10 bits/second and decreasing with the length of the drilling pipe. Moreover, the drilling fluid can not be too compressible, i.e. contain too much gas. The pressure pulses also disturb the pressure control and measurements in the well. At last, an active fluid flow is necessary for the communication, i.e. no information can be retrieved while the flow is stopped to connect new drill pipes at the top. Another difficult situation is the well shut inn, when it is important to receive information and the solution with signals transmitted with mud pulses will not provide this during well shut in.

Alternative drilling pipe systems is known, for example from WO 2009/011594.

Such a drilling pipe system comprises a first pipe provided concentric inside a second pipe by means of hanging devices, where one fluid is transferred down into the well in the compartment between the first pipe and the second pipe, and where the fluid together with cuttings etc from the drilling operation is transferred up in the compartment within the first pipe.

The object of the invention is to provide an improved method and system for transferring signals through a drill pipe system.

SUMMARY OF THE INVENTION

The present invention regards a method for transferring signals and or power through a drill pipe system during drilling of a subsurface well. There is therefore provided an electrical connection between elements topside and elements down in the well, for transferring electricity in the form of signals and or power. According to the invention the pipe system, a drill pipe, comprises a first pipe provided inside a second pipe by means of hanging devices; wherein the method comprises the steps of a) providing the first pipe electrically insulated from the second pipe; b) connecting a first signal transceiver and or a power supply device electrically to the top of the drill pipe system; c) connect a second signal transceiver and or a power consuming device electrically along or in the bottom of the drill pipe system; wherein the first and second signal transceivers and or power supply device and power consuming device are electrically connected to the first and second pipes for transferring the signals through the drill pipe system.

The power consuming device may be the same unit at the second transceiver, and there may be more than one power consuming device and or second transceiver or even an unit as a combination of both arranged along the pipe system. The system may be used for transmitting signals alone or power alone or as a system for transmitting both signals and power.

The first pipe may be arranged concentric within the second pipe. It is however conceivable to imagine the first pipe arranged within the second pipe, without them being arranged concentric. The first pipe may be electrically insulated from the second pipe in different manners. One possibility it to provide an electrical insulation layer on a side surface of one or both of the pipes on the side of the pipe facing the other pipe. Another possibility is to provide a non-conductive fluid in the annulus between the pipes and provide electrically insulated hanging devices between the pipes.

According to another aspect the method further may comprise the steps of: providing a mud pulse receiver near the second signal transceiver for converting mud pulse signals to electrical signals; transferring the converted mud pulse signals to the first signal transceiver.

According to yet another aspect the method further may comprises the steps of: applying multi carrier modulation for optimization of the data transfer rate.

According to the invention there is also provided a system for transferring signals and or power through a drill pipe system during drilling of a subsurface well. There is therefore provided a device for transferring electricity between units connected to the drill pipe, this electricity being signal and or power/effect. According to the invention the drill pipe system comprises a first pipe provided inside a second pipe by means of hanging devices wherein the first pipe is electrically insulated from the second pipe; a first, signal transceiver and or power supply device is electrically connected to the top of the drill pipe system; a second signal transceiver and or power consuming device is electrically connected along or in the bottom of the drill pipe system; wherein the first and second signal transceivers and or power supply device and power consuming device are electrically connected to the first and second pipes for transferring the signals and or power through the drill pipe system. The first pipe may be arranged concentric within the second pipe, but it is also possible to have a configuration where the pipes are not arranged concentrically.

The first and second pipe in such a system may be coiled pipes or segmented or jointed pipes assembled to form a concentric pipe string. The second signal transceivers may be a measurement while drilling tool (MWD-tool) and or a logging while drilling tool (LWD-tool) or possibly also other kind of tool down in the well. Examples of data transmitted may be temperature, pressure, weight, stress, vibration, position etc.

The hanging devices are arranged between the pipes and separating them while still allowing a flow of fluid through the annulus formed between the pipes. The hanging device may be formed as elements where at least a part of the device is formed by a non-conductive material. In another embodiment the hanging device may as such be made of a non-conductive material. The hanging device may additionally be part of a connection device for connecting segments of pipes to form a pipe string. The hanging device may then be configured such that is provides conductivity between the pipe segments forming a pipe string but at the same time electrically insulating the pipe strings from each other.

According to an aspect at least one of the pipes may comprise a layer of non-conductive material, providing electric insulation between the pipes. The layer may be arranged on a side of the first and or the second pipe facing the other pipe. This will when the first pipe is the inner pipe, on an outer surface of the first pipe and an inner surface of the second pipe, when this is the outer pipe. In an alternative embodiment there may not be a need for any non-conductive layer, as a fluid within the annulus between the pipes is more or less non-conductive, and in such an embodiment it is only necessary that the hanging devices are non-conductive.

According to an aspect of the invention the pipe string guiding the return flow of fluid from the well and up to the surface may be used for transmitting signals. This return pipe may in one embodiment be the inner pipe, the first pipe.

According to an aspect there may be more than one power consuming device and of second transceiver arranged connected to the drill pipe, receiving power or signals transmitted through the drill pipe. The second transceiver may also both receive and send signals.

According to another aspect of the invention the system comprises a piston arranged outside of the second pipe and during drilling within the well bore and a sealing packer arranged on the top of the well and means for delivering a hydraulic fluid to the annulus between the sealing packer and the piston. The piston will close the annulus formed between the second pipe and the wall of the bore hole. The sealing packer will close the well from the surroundings. The sealing packer is in one embodiment arranged above the BOP arranged as a closure element forming a top section of the well. The BOP has to be opened during drilling. By this the outer annulus will be divided into at least two sections, giving the possibility of providing hydraulic weight on the bit. A fluid may be added to the annulus above the piston and when pressurizing this fluid the piston and thereby the drill string will be forced further into the well. One may with such a system achieve a larger force on the bit of the drilling equipment arranged at the end of the drill string. Such a system will also extend the length for deviated drilling. The wall of the bore hole should here be understood to normally be a casing positioned in the bore hole and the inside wall of a BOP on top of this casing in addition to the newly drilled wall below the casing. Such a system was described in NO179261.

According to an aspect the system may also comprise an arrangement for providing a drilling fluid and receiving drilling fluid with cuttings to and from the centre of the first pipe and the annulus formed between the first pipe and the second pipe. In one embodiment where the whole drill string is rotated the sealing packer is a rotational sealing packer, allowing the drill string to rotate while at the same time providing sealing at the top of the well.

According to one aspect the drilling fluid is provided down through the annulus between the first and second pipe and returned through the first pipe. The drilling fluid may be a different kind of fluid compared with the hydraulic fluid provided in the annulus outside the drill string between the piston and the sealing packer.

DETAILED DESCRIPTION

In the following, embodiments of the invention will be described in detail with reference to the enclosed drawings, where:

Figure 1:
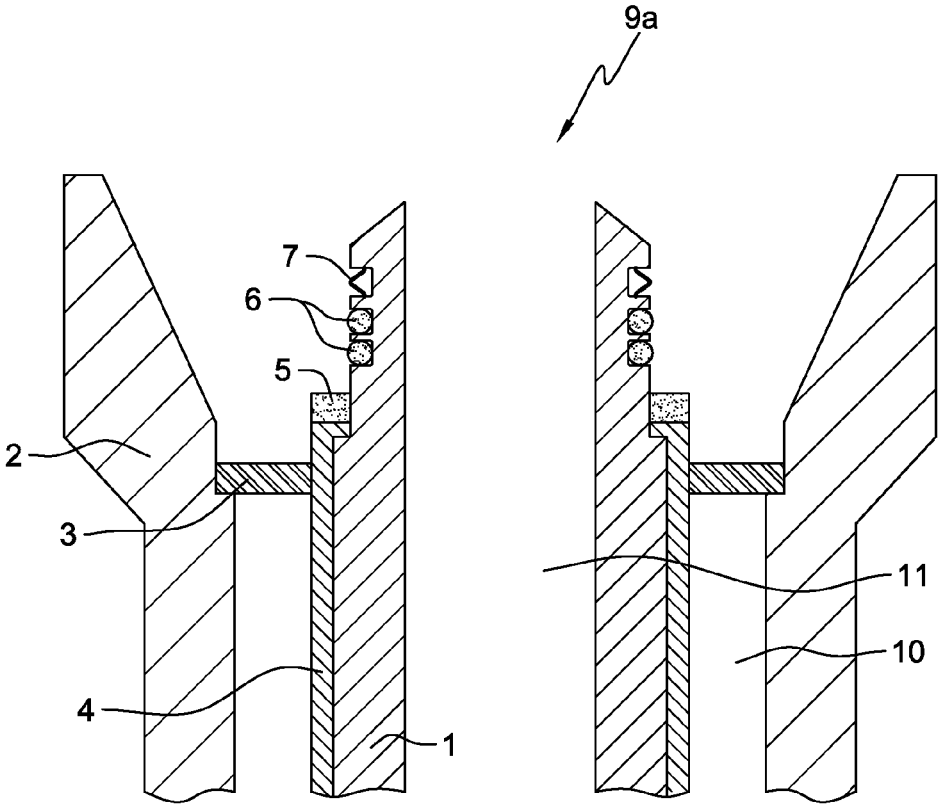
FIG. 1 shows a first, upper end of a section of the drill pipe system.
Figure 4:
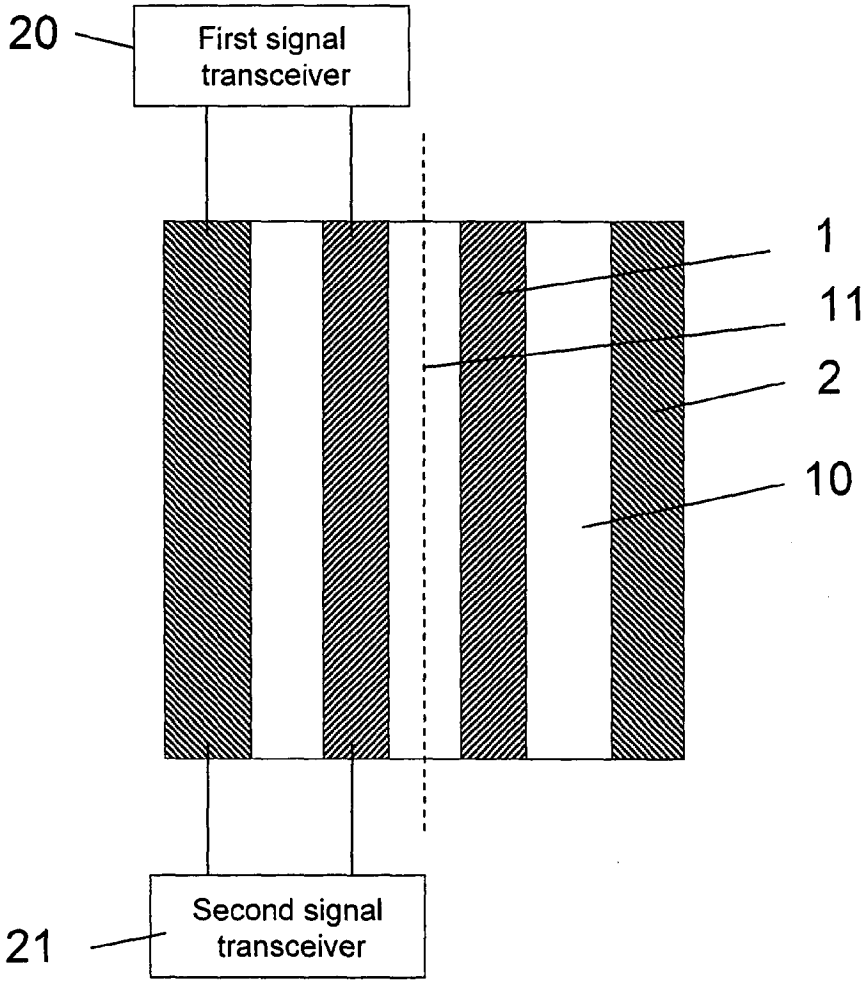
FIG. 4 illustrates a first embodiment of the invention.

It is now referred to FIGS. 1 and 4, where a drill pipe system used during drilling of a subsurface well is shown. In the present embodiment, the subsurface well is an hydrocarbon well. The drill pipe system comprises a first pipe 1 provided concentric inside a second pipe 2 by means of hanging devices 3. The first and second pipes 1, 2 are made of an electrically conducting material.

In the drill pipe system there are two main compartments for transferring fluids through this drill pipe system.

Reference number 10 refers to the first compartment, which is between the first pipe 1 and the second pipe 2. During drilling, drilling fluid is transferred down through this first compartment 10 to the drilling equipment in the bottom of the drill pipe system.

Reference number 11 refers to the second compartment, which is within the first pipe 1. During drilling, cuttings, mud etc is transferred up through this second compartment 11 to the surface.

It should be noted that the present invention may be used both in relation to drill pipe systems for subsea wells as well as for drill pipe systems for land based wells.

The hanging devices provide that the first pipe is held concentric inside the second pipe 2. The hanging devices may also comprise centralizers 3*a* or other type of distance elements.

In the system according to the invention, the first pipe 1 is electrically insulated from the second pipe 2. If the fluid in the first compartment 10 is a dielectric or electric insulating fluid, no further insulations means are necessary. However, an electric insulation layer 4 may be provided on the outside surface of the first pipe 1. Alternatively, an electric insulation layer may be provided on the inner surface of the second pipe 2. In such embodiments, the fluid in the first compartment 10 is allowed to be electrically conductive. In yet an alternative embodiment, an insulation layer may be provided both on the outside surface of the first pipe 1 and on the inside surface of the second pipe 2. Such an embodiment will increase the robustness of the drill pipe system with respect to signal transfer.

The hanging devices 3, 3*a* may also be made of an electric insulating material.

Figure 2:
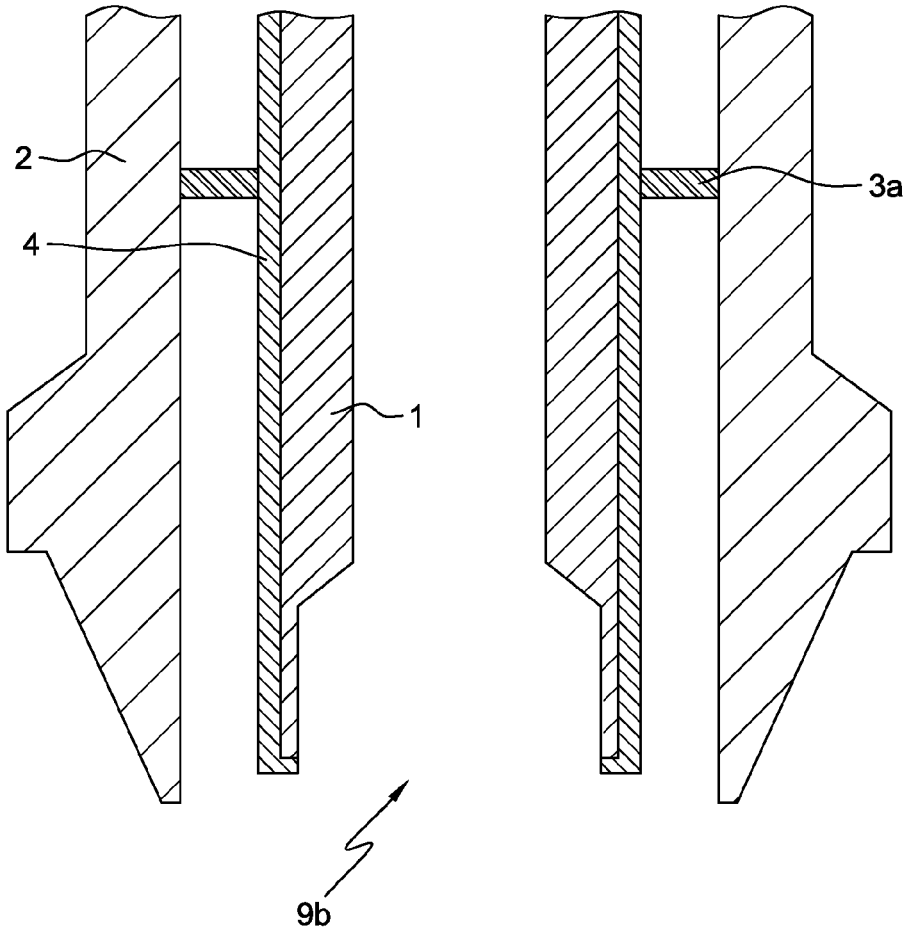
FIG. 2 shows a second, lower end of a section of the drill pipe system.
Figure 3:
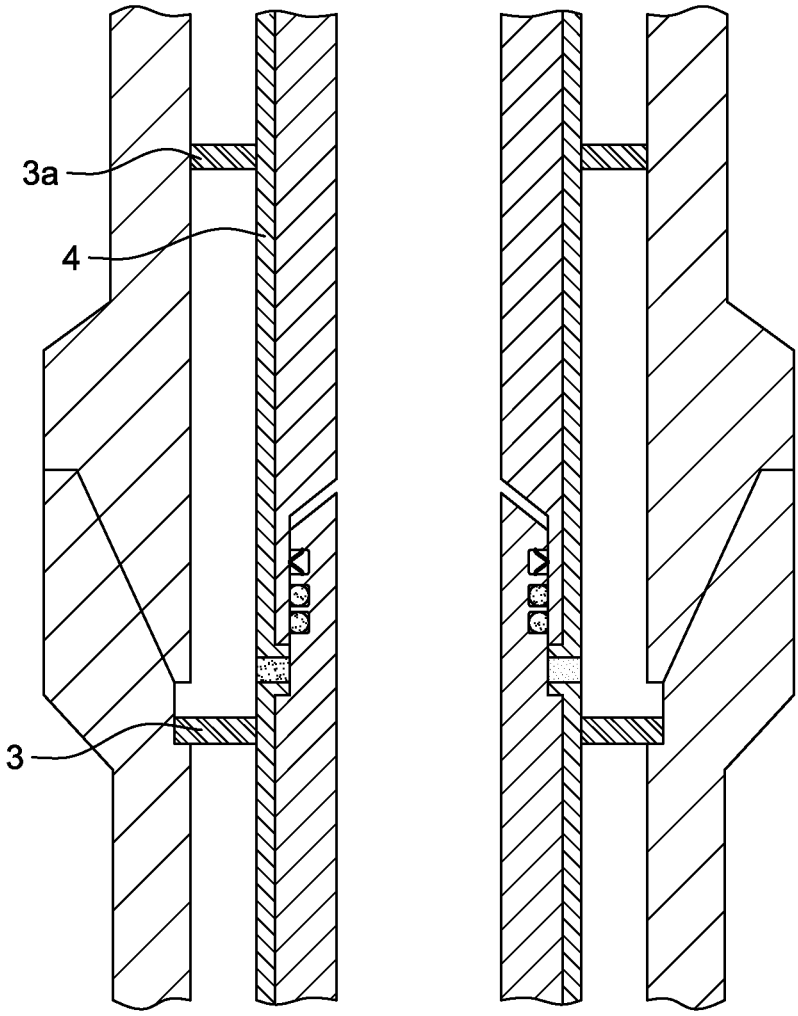
FIG. 3 shows the first end of one section is assembled with the second end of another section.

It is now referred to FIGS. 1-3. The upper end of a section of the drill pipe system comprises a first connection interface 9*a* (FIG. 1) and the lower end of a section of the drill pipe system comprises a second connection interface 9*b* (FIG. 2). The first connection interface 9*a* of one section is adapted to be connected to the second connection interface 9*b* of another section, as shown in FIG. 3.

The first connection interface 9*a* comprises a seal 5 for the electrical insulation layer 4, which, when assembled, provides a continuous insulation layer 4. Moreover, the first connection interface 9*a* comprises pressure seals 6 to keeping the fluid compartments 10, 11 separated from each other. Moreover, the first connection interface 9*a* comprises an electrical contact spring 7 for providing electrical contact between different sections of first pipes 1.

The first connection interface 9*a* also provides an electrical contact between different sections of second pipes 2.

Hence it is achieved that a drill pipe system comprising several assembled sections has one continuous electrical conductor constituted by the first pipe 1 and another continuous electrical conductor constituted by the second pipe 2. Moreover, the insulation layer 4 is also continuous along the overall length of the drill pipe system. Of course, the connection interfaces 9*a*, 9*b* must also fulfill requirements with respect to continuous fluid compartments 10, 11, mechanical requirements etc.

It is now referred to FIG. 4, where it is shown that a first signal transceiver 20 is electrically connected to the top of the drill pipe system. That is, the first signal transceiver 20 is electrically connected to the first and second pipes 1, 2 for transferring the signals through the drill pipe system. The first signal transceiver 20 may for example be connected to monitoring systems etc on the surface, for indicating the status of different parameters in the well.

A second signal transceiver 21 is electrically connected in the bottom of the drill pipe system. That is, the second signal transceiver 21 is electrically connected to the first and second pipes 1, 2 for transferring the signals through the drill pipe system. The second signal transceiver 21 may for example be connected to sensors etc for measuring pressure, temperature gamma-radiation, resistivity, porosity, pH, inclination, azimuth, acceleration etc. The sensors may be located near the second signal transceiver 21

Hence, the first pipe 1 provides a first signal conductor and the second pipe 2 provides a second signal conductor between the first and second signal transceivers 20 and 21. Hence, signals may be sent between the first and second signal transceivers via the first and second pipe.

It is of course possible to have several signal transceivers along or in the bottom of the drill pipe system.

Figure 5:
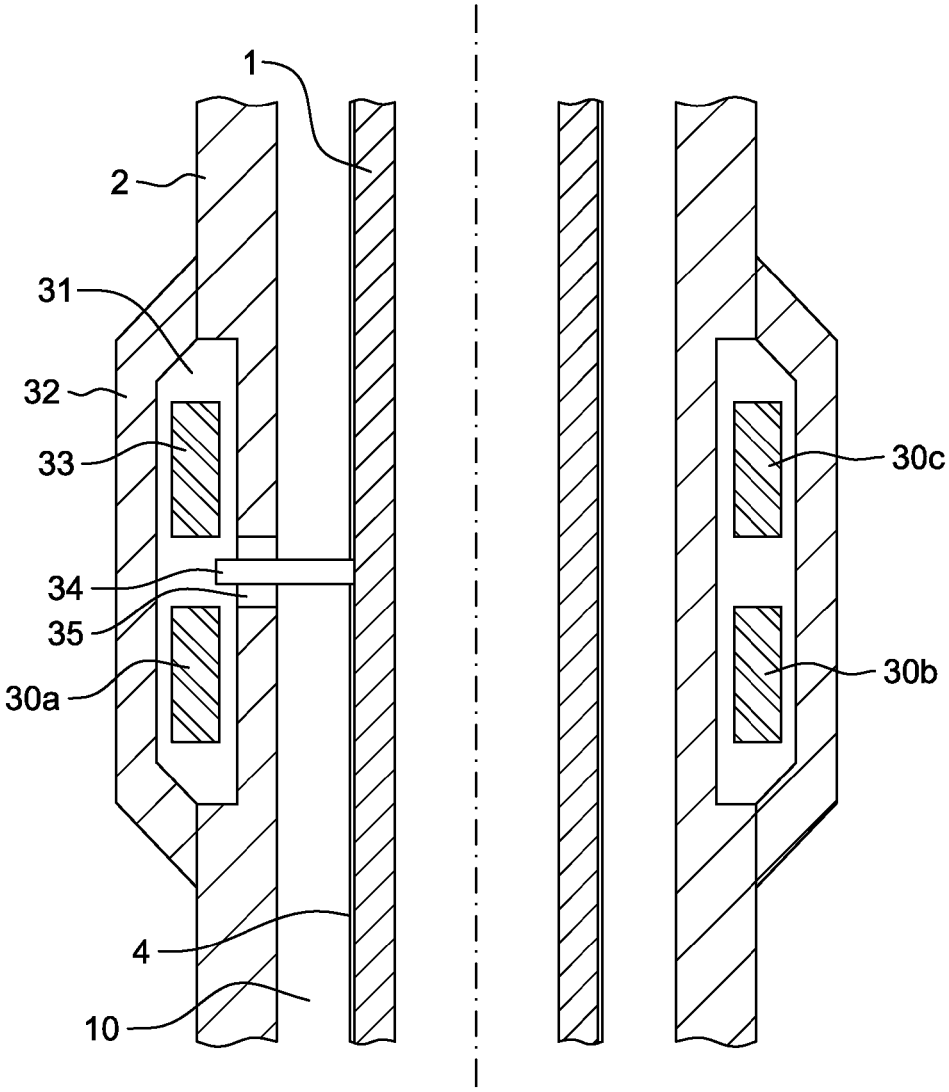
FIG. 5 illustrates a sensor section of the drill pipe system.

In case it is desired to have sensors along the drill pipe system, this may be provided by means of a separate sensor section as illustrated in FIG. 5. Even though not shown in FIG. 5, the sensor section comprises first and second connection interfaces 9*a*, 9*b* in its respective upper and lower end. Hence, the sensor section may be connected at a desired interval between "normal" sections as shown in FIG. 1-3.

The sensor section may comprise one or several sensors 30*a-c* provided in a recess or opening 31 in the second pipe 2. A lid or cover 32 may be provided outside the opening 31 for protection of the equipment in the opening 31. The sensors 30*a-c* is connected to a third signal transceiver 33, also provided in the opening 31. The third signal transceiver 33 is, similar to the first and second signal transceivers 20, 21 connected to both the first and the second pipe 1 and 2. Since the third signal transceiver 33 is located in the opening 31, it may easily be connected to the second pipe 2 by means of a wire or other type of electrical connector (not shown). The third signal transceiver 33 may be connected to the first pipe 1 by means of a penetrator 34 extending radially into the first compartment 10 from the second pipe 2 towards the first pipe 1. The penetrator 34 is electrically insulated from the second pipe 2 by means of an insulator 35. Moreover, the penetrator is in electrical contact with the first pipe 1, i.e. the penetrator 34 is penetrating the insulation layer 4 on the outside surface of the first pipe 1.

Figure 6:
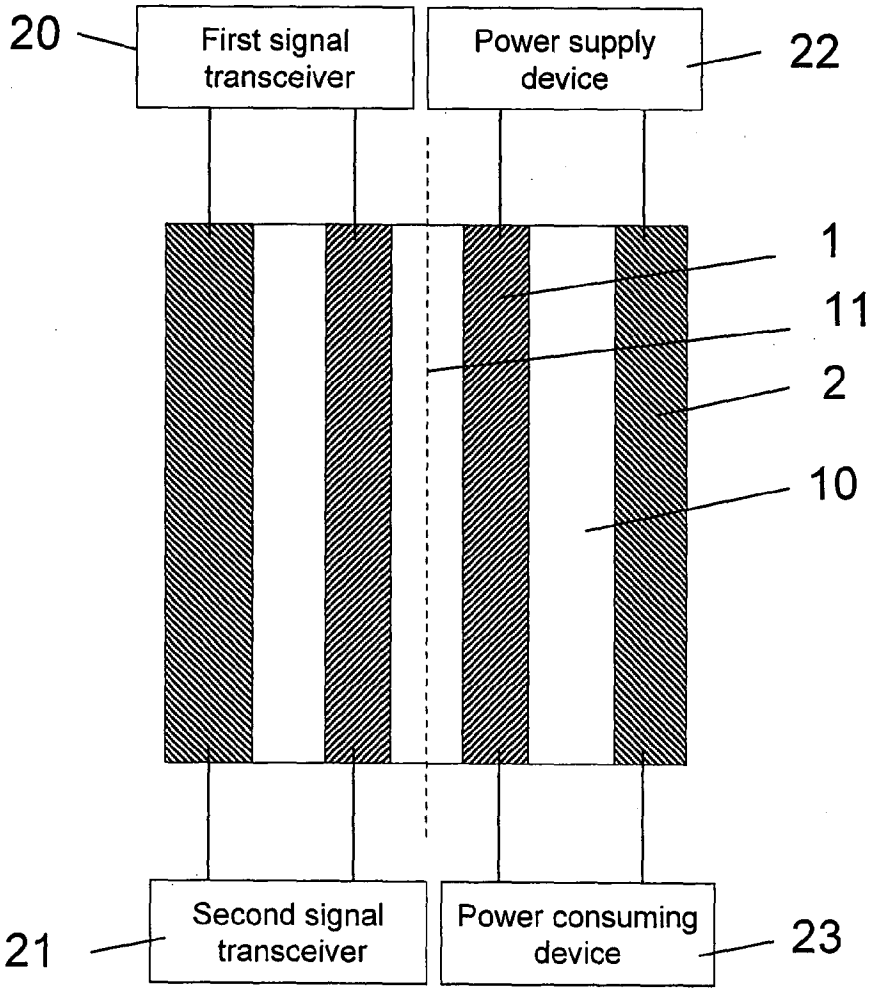
FIG. 6 illustrates a second embodiment of the invention.

It is now referred to FIG. 6. Here the system according to the invention further comprises a power supply device 22 provided in the top of the drill pipe system and a power consuming device 23 provided along or in the bottom of the drill pipe system. The power supply device 22 and the power consuming device 23 are electrically connected to the first and second pipes 1, 2 for transferring electrical power from the power supply device to the power consuming. The power may be an AC power supply or a DC power supply. However, the frequency of the AC power supply should not interfere with the signals transferred between the first and second signal transceivers. Alternatively, the signals may be modulated onto and read from the power in a separate unit instead of connecting them directly to the pipes, for example by using filter units etc.

To utilize already existing equipment, a mud pulse receiver may be connected to the second signal transceiver. The mud pulse receiver is provided for receiving and converting mud pulse signals to electrical signals, whereby the converted mud pulse signal is sent to the second signal transceiver and further up to the first signal transceiver. Hence, traditional mud pulse communicating equipment may be utilized together with the present invention.

The first and second signal transceivers may be communicating by means of multi carrier modulation for optimization of the data transfer rate. Since the conductivity and signal transfer ability for the first and second pipe string may vary according to their length, drilling operation conditions etc it is achieved an optimal data transfer rate.

According to the invention, also a method for transferring signals through a drill pipe system during drilling of a hydrocarbon well is provided.

In a first step, a first signal transceiver is connected electrically to the top of the drill pipe system.

In a next step a second signal transceiver is connected electrically along or in the bottom of the drill pipe system. As described above, the first and second signal transceivers are electrically connected to the first and second pipes for transferring the signals through the drill pipe system.

The method may comprise the step of applying an insulation layer 4 on the outside surface of the first pipe 1.

The method may comprise the step of providing the hanging devices of an electric insulating material.

The method may comprise the step of providing a power supply device in the top of the drill pipe system and providing a power consuming device along or in the bottom of the drill pipe system. As described above, the power supply device and the power consuming device are electrically connected to the first and second pipes for transferring electrical power from the power supply device to the power consuming device.

The method may comprise the step of providing a mud pulse receiver near the second signal transceiver for converting mud pulse signals to electrical signals, where the converted mud pulse signals are transferred to the first signal transceiver.

The method may comprise the step of applying multi carrier modulation for optimization of the data transfer rate.

The electrical properties of the drill pipe system, such as attenuation and frequency response, will change according to the length of the drill pipe system and the electrical properties of the drilling fluid. Drilling fluid conductivity and dielectric coefficient is likely to change during drilling into different geological formations. Consequently, the transceivers may use signal modulation techniques which are suitable. One such technique is so-called multi-carrier modulasjon, for example Ortogonal Frequency Division Multipleks (OFDM). A capacity of several tens of Mbit/s may be achieved. More conventional methods, such as Frequency Shift Keying (FSK), Phase Shift Keying (PSK) or Quadrature Amplitude Modulation (QAM) may also be used.

Figure 7:
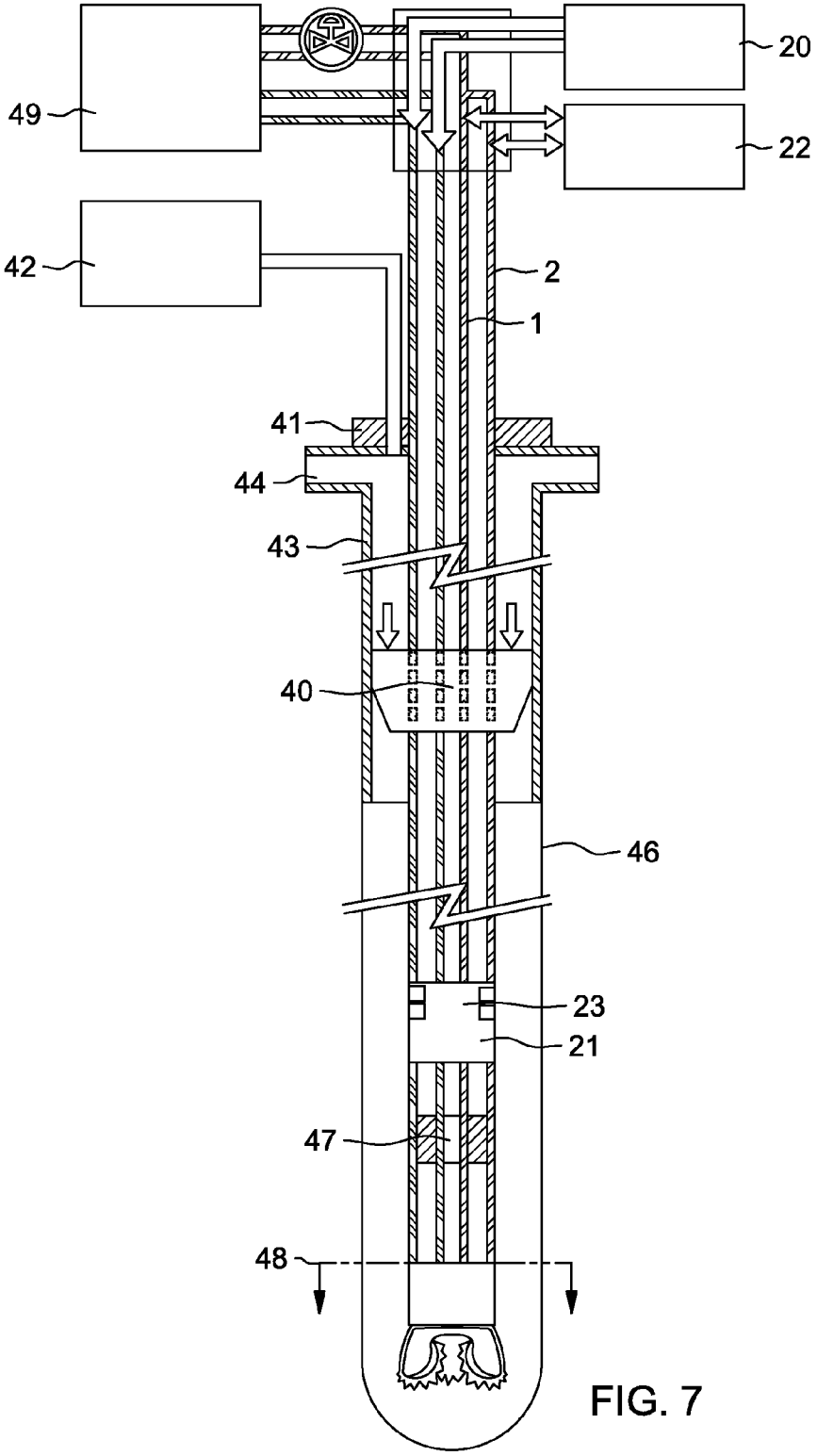
FIG. 7 illustrates a schematic use of the invention in a well.

In FIG. 7 there is shown a schematic use of the invention in a well. The well comprises a BOP 44 arranged at the top of the well, casing 43 extending from the BOP 44 and down in the ground a distance and a new drilled bit of the well 46. This newly drilled bit is not yet formed with a casing.

The system according to the invention comprises a first pipe 1 and a second pipe 2 arranged around the first pipe string, in the shown embodiment arranged concentrically. There is a first signal transceiver 20 arranged at the top of the drill string and electrically connected to the two pipes 1,2, and a second signal transceiver 21 arranged at the drill string down in the well and electrically connected to the two pipes 1,2. This gives the possibility to transmit large amounts of data between the first and the second signals transceivers. One may by this have a measurement while drilling tool and/or a logging while drilling tool in the well, and data transmitted from these an up to an operator at the surface. Additionally there is a power supply device 22 arranged connected to the two pipes 1,2 at the top of these, and a power consuming device 23 arranged in the well and connected to the two drill pipes 1,2. By this one may transfer power to the power consuming devices 23 through the drill pipes 1,2. The system further comprises a piston 40 attached to the second drill pipe 2, which piston 40 dividing an annulus formed between the second pipe 2 and the wall of the well into two separate sections. The system further comprises a sealing package 41 arranged at the top of the well, sealing the annulus formed between the drill pipe and the well from the surroundings. The piston is following the drill pipe and is abutting the casing 43 of the wall of the well. The sealing package 41 is in sealing engagement with the second pipe 2 and with the BOP 44 forming part of the well in the shown embodiment. The system also comprises an arrangement 42 for providing a hydraulic fluid to the annulus between the sealing package 41 and the piston 40. The system with the transfer of signals and power may also very well function in a drill pipe without the piston 40. The drill string comprising the first and second pipe 1,2, comprises in the shown embedment a top drive adapter 45, and an arrangement 49 for providing a drilling fluid into the drill string and circulating this drilling fluid in the drill string. The drill string is at the opposite end provided with a bottom hole assembly 48, possibly comprising a drilling motor, power transformer, drill bit, of conventional configuration. The drill string will also comprise a valve assembly 47 at the bottom hole assembly or further up in the drill string, which valve assembly 47 provides for closing the different flow paths and in one possible embodiment not shown in the figure guiding an annulus flow around the drill bit to a central flow passage in the drill string and a central flow passage around the drill bit to an annulus flow passage in the drill string.

The abovementioned detailed description is especially provided to illustrate and to describe preferred embodiments of the invention. However, the description is by no means limiting the invention to the specific embodiments. As mentioned in the description, the subsurface well may be a hydrocarbon well or a water injection well or other types of subsurface wells. The signal and power transferring system may be used with a dual drill pipe with or without an outer piston fro providing weight on the bit. The system may be used for transferring power and or signals. The signals may different kinds of signals, s of temperature, pressure, weight, vibration, position etc. The drill pipe may be formed with an even outer diameter thereby forming an even outer surface of the drill pipe. The drill pipe may be used for different kinds of drilling, vertical or deviated drilling, there among horizontal drilling. The system may be used on land based drilling rigs or when drilling subsea wells.

The invention claimed is:

1. A method for transferring signals and or power through a drill pipe system during drilling of a subsurface well, wherein the pipe system comprises a first pipe provided inside a second pipe by means of hanging devices; wherein the method comprises the steps of:

a) providing the first pipe electrically insulated from the second pipe and a fluid passage between the first pipe and the second pipe for transferring fluid;

b) connecting a first signal transceiver and or a power supply device electrically to the top of the drill pipe system;

c) connecting a second signal transceiver and or a power consuming device electrically along or in the bottom of the drill pipe system;

wherein the first and second signal transceivers and or power supply device and power consuming device are electrically connected to the first and second pipes for transferring the signals and or power through the drill pipe system.

2. The method according to claim 1, wherein the method further comprises the steps of:

providing a mud pulse receiver near the second signal transceiver for converting mud pulse signals to electrical signals; and transferring the converted mud pulse signals to the first signal transceiver.

3. The method according to claim 1 or 2, wherein the method further comprises the step of:

applying multi carrier modulation for optimization of the data transfer rate.

4. The method according to claim 1, further comprising providing signals and or power to signal transceivers and or power consuming devices at more than one position along the drill string.

5. The method according to claim 1, further comprising providing the first pipe concentrically within the second pipe.

6. A system for transferring signals through a drill pipe system during drilling of a subsurface well, wherein the drill pipe system comprises a first pipe provided inside a second pipe by means of hanging devices, wherein:

the first pipe is electrically insulated from the second pipe and a fluid passage is provided between the first pipe and the second pipe for transferring fluid;

a first signal transceiver and or power supply device is electrically connected to the top of the drill pipe system;

a second signal transceiver and or power consuming device is electrically connected along or in the bottom of the drill pipe system;

wherein the first and second signal transceivers and or power source and power consuming device are electrically connected to the first and second pipes for transferring the signals and or power through the drill pipe system.

7. The system according to claim 6, wherein the drill pipe system comprises a piston arranged outside and connected to the second pipe and a sealing package arranged for sealing off the well from the surroundings, and an arrangement for providing a hydraulic fluid in an annulus section which during use is formed outside the second pipe and between the piston and the sealing package.

8. The system according to one of claim 6 or 7, wherein the first signal transceiver and or the power supply device is connected to the first and second pipe through a top drive adapter arranged at the top of the drill pipe system.

9. The system according to claim 6, wherein the first and the second pipe are arranged concentrically.

10. The system according to claim 6, wherein the hanging device is formed at least in part of a non-conductive material.

11. The system according to claim 6, wherein the first and or the second pipe comprises an electrical insulating layer arranged on a side of the pipe facing the other pipe.

12. The system according to claim 6, wherein a plurality of second transceivers and or power consuming devices are arranged along the length of the drill pipe.

13. The system according to claim 6, wherein a dielectric or electrically insulating fluid in the fluid passage electrically insulates the first pipe from the second pipe.

* * * * *